United States Patent [19]

Passage, Jr.

[11] Patent Number: 5,012,749

[45] Date of Patent: May 7, 1991

[54] RADIO CONTROLLED MATERIAL HANDLING APPARATUS

[75] Inventor: Robert D. Passage, Jr., Bay City, Mich.

[73] Assignee: The Allen Group Inc., Saginaw, Mich.

[21] Appl. No.: 595,692

[22] Filed: Oct. 4, 1990

Related U.S. Application Data

[63] Continuation of Ser. No. 290,753, Dec. 27, 1988, abandoned.

[51] Int. Cl.[5] ..... B61C 17/12; B61L 3/16

[52] U.S. Cl. ..... 104/297; 104/299; 246/182 R; 246/167 A; 246/187 A

[58] Field of Search ..... 104/297, 299, 300, 295, 104/296; 180/167; 246/187 A, 187 B, 182 R, 182 A, 122, 167 A, 263

[56] References Cited

U.S. PATENT DOCUMENTS

| | | | |
|---|---|---|---|
| 1,907,974 | 5/1933 | Johnston | 246/187 A |
| 3,072,785 | 1/1963 | Hailes | 246/187 |
| 3,214,038 | 10/1965 | Davison et al. | 246/187 B |
| 3,263,625 | 8/1966 | Midis et al. | 246/187 B |
| 3,639,755 | 2/1972 | Wrege | 246/187 B |
| 3,819,932 | 6/1974 | Auer, Jr. et al. | 246/187 B X |
| 3,884,437 | 5/1975 | Lindermann | 246/187 B X |
| 3,974,778 | 8/1976 | Black et al. | 104/299 X |
| 4,279,395 | 7/1981 | Boggio et al. | 246/182 R |
| 4,570,543 | 2/1986 | Ishikura et al. | 104/300 |
| 4,718,622 | 1/1988 | Rahman | 246/167 R |

*Primary Examiner*—Joseph F. Peters, Jr.
*Assistant Examiner*—Virna Lissi Mojica
*Attorney, Agent, or Firm*—Learman & McCulloch

[57] ABSTRACT

A material handling system, such as a monorail material handling system, and a delivery device therefor which is intelligent, self-powered and capable of communicating with a central system control via a radio frequency communication link without direct electrical connection therewith. The material handling system comprises at least one delivery device, a pathway along which the delivery device is adapted to be propelled, and a central electronic control for controlling operation of the system. Each delivery device includes a drive for propelling the delivery device along the pathway, an onboard power supply for providing power to the drive, and an onboard electronic control for controlling operation of the delivery device. The onboard electronic control and the central electronic control include radio frequency communications for providing a radio communication link therebetween. The onboard electronic control also includes a data processor for processing data received from the central electronic control and from external monitors connected thereto and for generating signals to carry out many of the control functions normally performed by a central system control.

7 Claims, 6 Drawing Sheets

RADIO CONTROLLED MATERIAL HANDLING APPARATUS

This is a continuation of copending application Ser. No. 07/290,753, filed on Dec. 27, 1988, now abandoned.

The present invention relates generally to a material handling system and more particularly to a delivery device for material handling systems that is self-powered and capable of communicating with a central system control via a radio frequency communication link.

BACKGROUND OF THE INVENTION

Material handling systems are frequently used in business and industry to transport materials from one location to another. Such systems typically include a delivery device for carrying the materials which are to be transported, and means defining a pathway along which the delivery device is adapted to travel. In addition, many material handling systems also include a central system control for controlling the operation of one or more delivery devices as they travel through the system, and for generally monitoring the condition of the system.

One known type of material handling system is a monorail material handling system in which the pathway defining means comprises an elevated track system, and the delivery device comprises a trolley having one or more drive motors thereon for propelling the trolley along the track system.

In known monorail material handling systems, the central system control is electrically connected to the one or more trolleys in the system by an electrically conductive track or bus incorporated into the track system thereof. The bus includes a plurality of separate conductors, and the central system control provides power (typically 240 volts A.C.) for powering the drive motors of the trolleys and control signals for controlling the operation of the trolleys via the bus. The central system control is connected to the bus by electrical wiring, and the trolleys include an arrangement of conductive collectors or brushes slideably engageable with the bus to maintain electrical connection therewith as the trolleys travel through the system.

In a large material handling system, the wiring connecting the central system control to the electrically conductive bus can be several hundred feet in length. This large amount of wiring requires a substantial investment in both installation time and material. In addition, the sliding electrical connections between the fixed bus and the brushes on the moving trolleys necessitate diligent monitoring and frequent maintenance to ensure reliable operation of the system.

Moreover, the electrically conductive bus, its attendant electrical wiring, and the high voltage power carried thereby present a substantial electrical shock hazard and prevent use of the system in many environments which require explosion-proof or fire-proof conditions.

Furthermore, in known monorail material handling systems substantially all system operations are controlled and monitored from the central system control as a result of which the central system control often requires a relatively expensive computer having a large memory capacity.

SUMMARY OF THE INVENTION

The present invention relates to a material handling system, such as a monorail material handling system, and to a delivery device therefor which is self-powered and which includes an onboard electronic control means capable of performing many of the control functions normally carried out by a central system control. The delivery device is capable of communicating with the central system control via a radio frequency communication link without direct electrical connection therewith.

The material handling system of the present invention comprises at least one delivery device, means defining a pathway along which the delivery device is adapted to be propelled, and central electronic control means for controlling the overall operation of the system. Each of the delivery devices includes drive means for propelling the delivery device along the pathway defining means, an onboard power supply for providing power to the drive means, and an onboard electronic control means for controlling operation of the delivery device. The onboard electronic control means and the central electronic control means include radio frequency communication means for providing a radio frequency communication link between the central electronic control means and the onboard electronic control means.

The material handling system of the present invention does not require a track system having an electrically conductive bus associated therewith, nor does it require the electrical wiring normally required to connect a central system control to the bus, or an arrangement of brushes for providing electrical contact between the bus and the delivery devices. Accordingly, the material handling system of the present invention can be more efficiently installed and operated in a safe, reliable manner in substantially all environments.

According to a presently preferred embodiment of the invention, the material handling system comprises a monorail material handling system, and each delivery device comprises a trolley adapted to be propelled along an elevated monorail track system between a loading station at which material to be transported is loaded onto the trolley, and an unloading station at which the material is unloaded. The drive means comprises a D.C. electric motor connected to a driven wheel of the trolley, and the onboard power supply comprises rechargeable battery means incorporated into a control circuit of the onboard electronic control means for supplying power to both the motor and the onboard electronic control means.

According to one aspect of the invention, the onboard electronic control means includes means for controlling the speed at which the trolley is propelled along the track system. Specifically, the track system includes a plurality of speed changing means positioned at predetermined locations therealong, and the onboard electronic control means includes means responsive to the speed changing means for changing the speed of the trolley between fast and slow speeds as appropriate as the trolley travels through the system.

The onboard electronic control means also includes means for monitoring the position of the trolley as it travels through the system. This information is used by the onboard electronic control means and the central electronic means to initiate various actions at the appropriate time as the trolley travels through the system.

The onboard electronic control means also includes means for monitoring the charge of the battery and the material handling system includes means for automatically recharging the battery at predetermined intervals as a function of the particular duty cycle of the trolley. In accordance with a presently preferred embodiment, the recharging means is located in a trolley repair/battery recharging area of the system which is positioned to receive empty trolleys as they return from the unloading station to the loading station so as to minimize interruption of the overall operation of the system.

In accordance with a further aspect of the invention, the onboard electronic control means on each trolley includes data processing means, such as a microprocessor, for processing data received from the central electronic control means and from various trolley components; and for generating signals to control various components on the trolley. The onboard electronic control means is thus able to carry out many of the control functions normally performed by a central electronic control means permitting a smaller, less expensive computer with reduced memory capacity to be incorporated in the central electronic control means, and generally providing for more efficient system operation.

The radio frequency communication means preferably comprises a low-powered, frequency modulated radio system to eliminate interference from other electrical equipment that may be in the area in which the system is used. The radio system includes a transceiver unit on each trolley in the system to communicate with a similar unit in the central electronic control means.

In general, the material handling system of the present invention is capable of operating safely and reliably in a substantially fully automatic manner with minimum operator involvement. Operator intervention is normally required only to load or unload a trolley or when repair of a trolley is necessary. The system also includes a number of safety features to prevent accidents or breakdowns that will interfere with the smooth operation of the system.

Further advantages and specific details of the invention will be set forth hereinafter in conjunction with the following detailed description of a presently preferred embodiment.

THE DRAWINGS

FIG. 1A schematically illustrates a material handling system according to a presently preferred embodiment of the invention;

Figure 2:
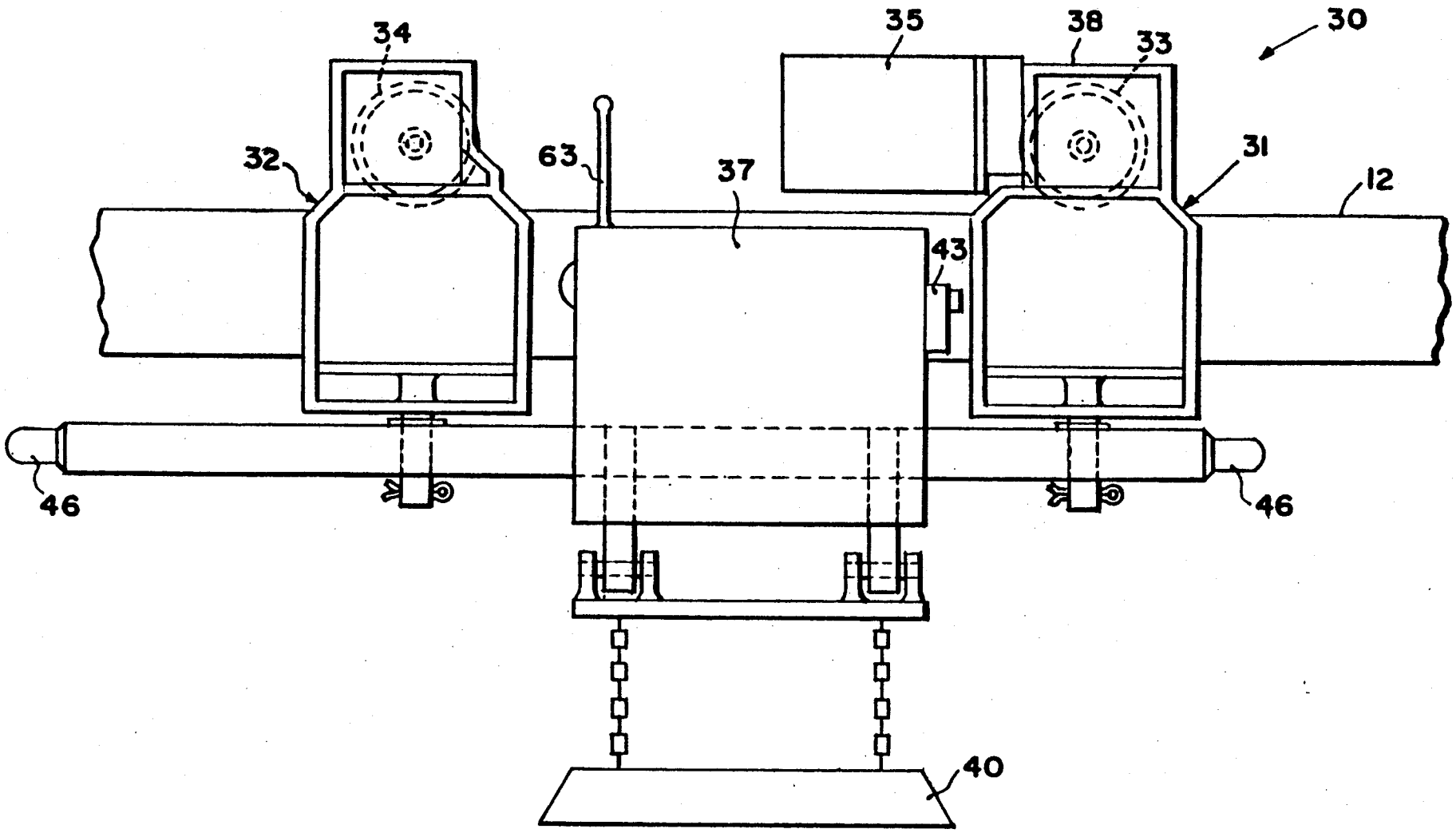
FIG. 2 is a schematic side view of a trolley utilized in the material handling system of FIG. 1A.
Figure 3:
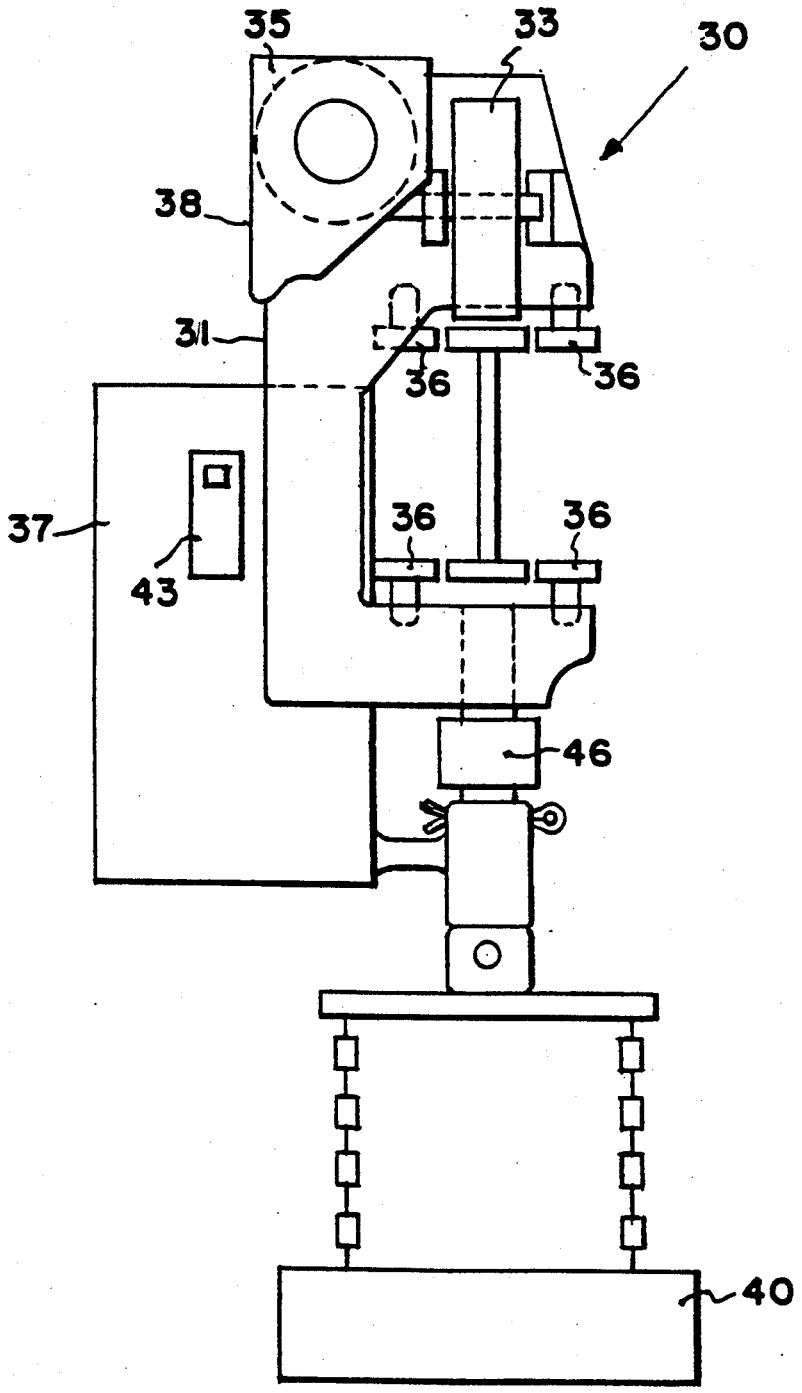
FIG. 3 is an end view of the trolley of FIG. 2.
Figure 4A:
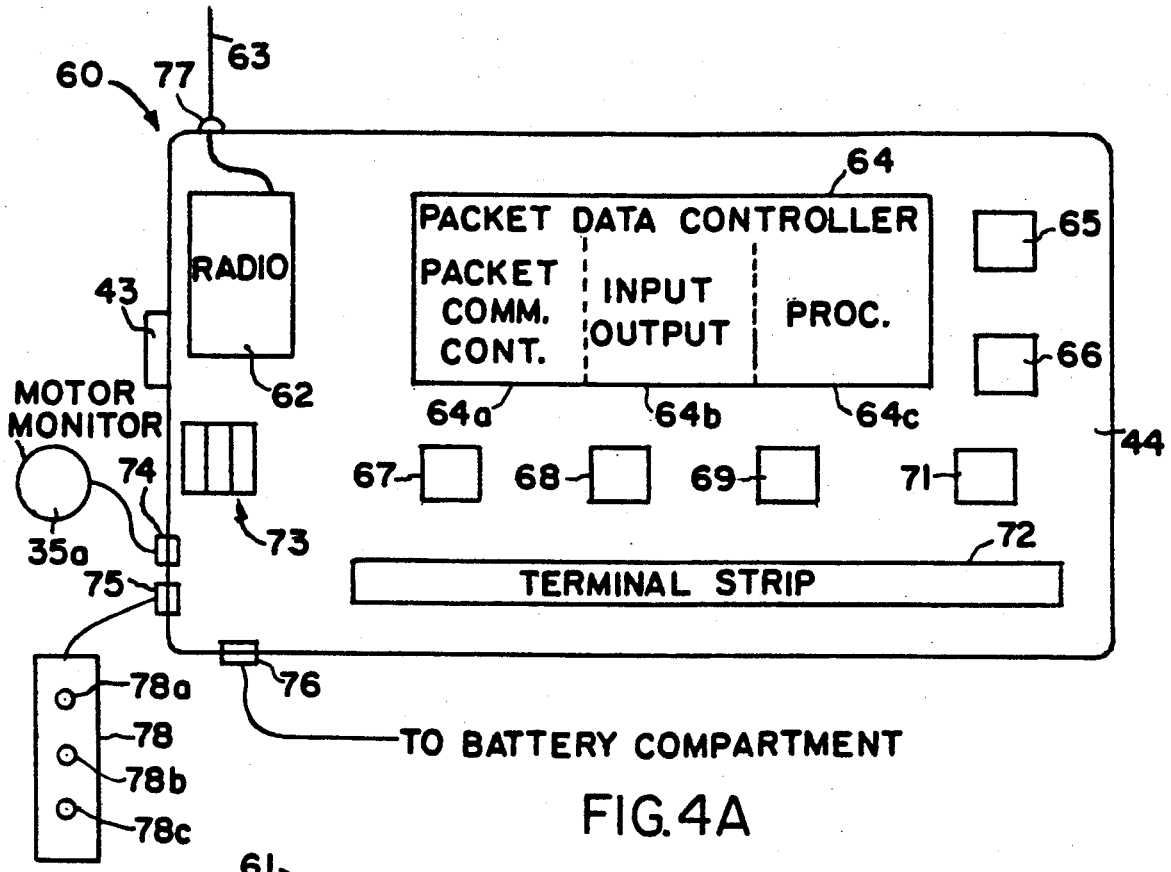
Figure 4B:
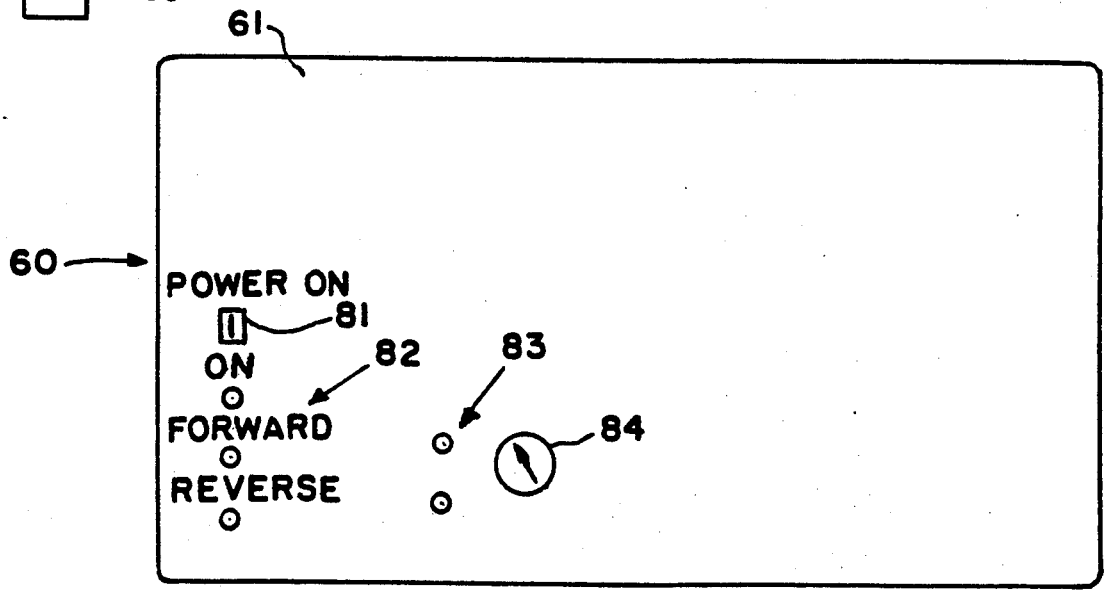
Figure 5:
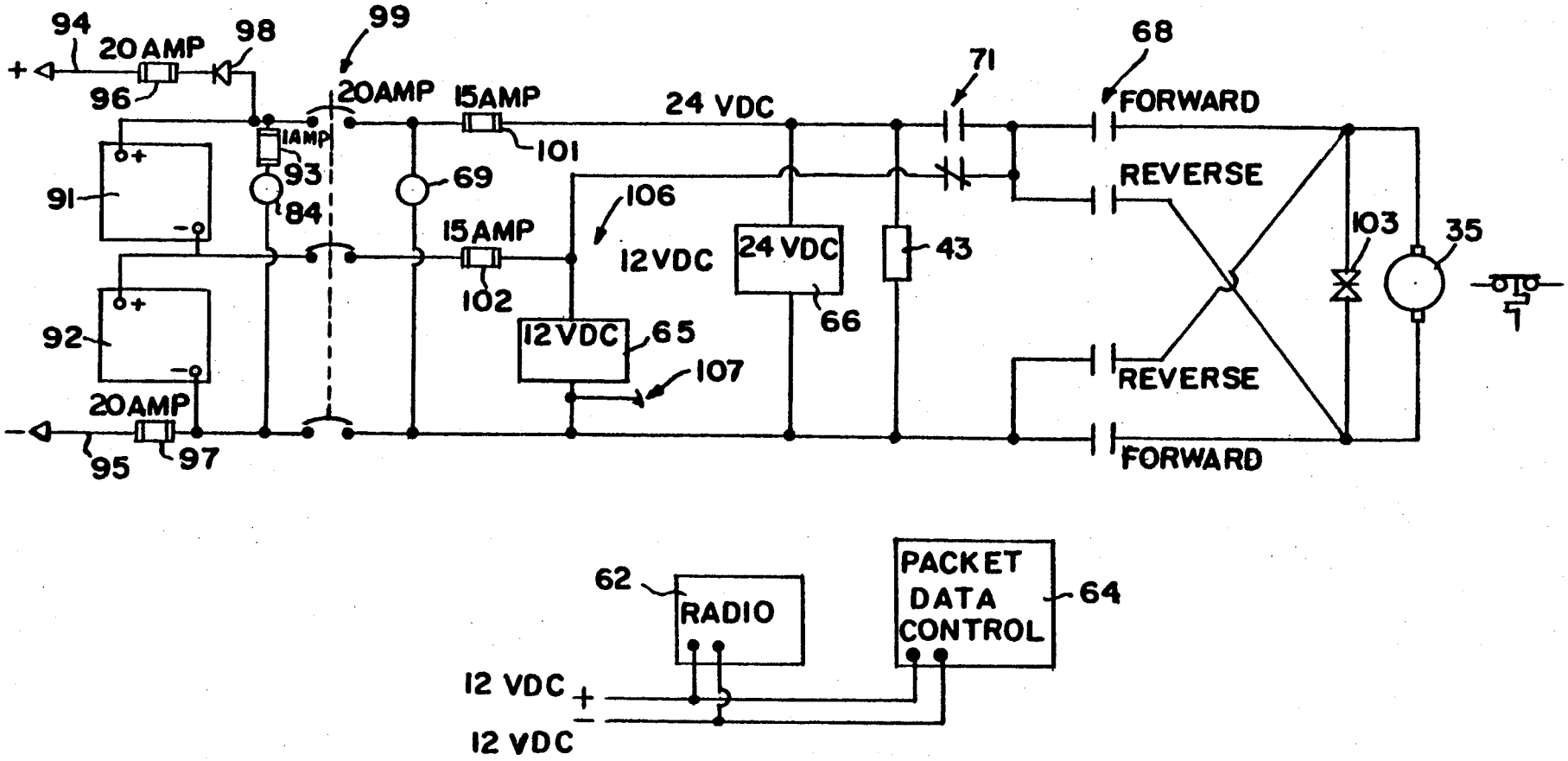
Figure 6:
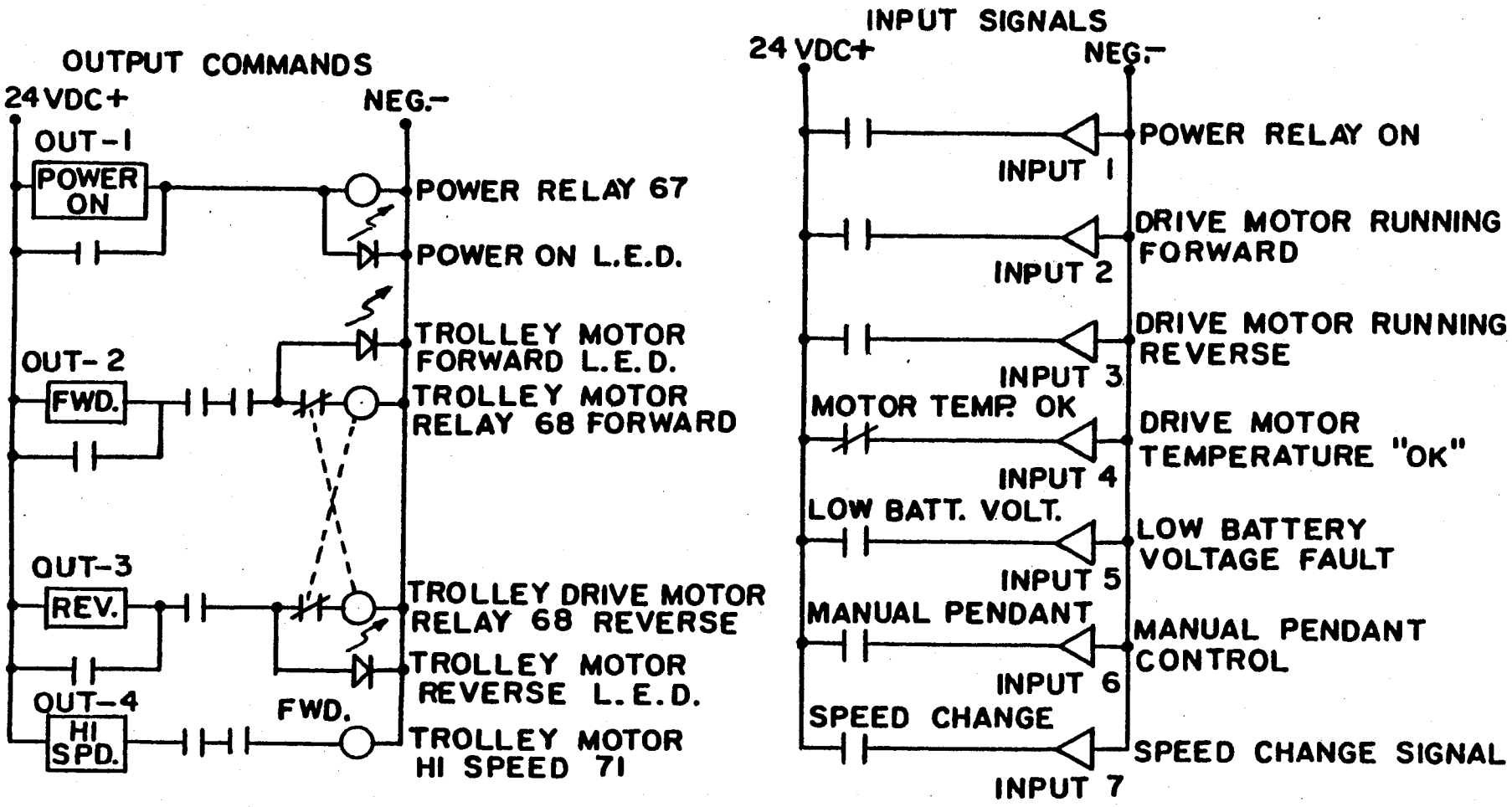

FIG. 4A schematically illustrates the interior of the control compartment of the battery and control enclosure of the trolley of FIGS. 2 and 3;

FIG. 4B schematically illustrates the front cover of the control compartment of FIG. 4A;

FIG. 5 illustrates the control circuit incorporated in the onboard electronic control means of the trolley of FIGS. 2 and 3; and FIG. 6 schematically illustrates the manner in which the onboard electronic control means controls the operation of the drive motor of the trolley of FIGS. 2 and 3 and other components.

THE PREFERRED EMBODIMENT

Figures 1A, 1B:
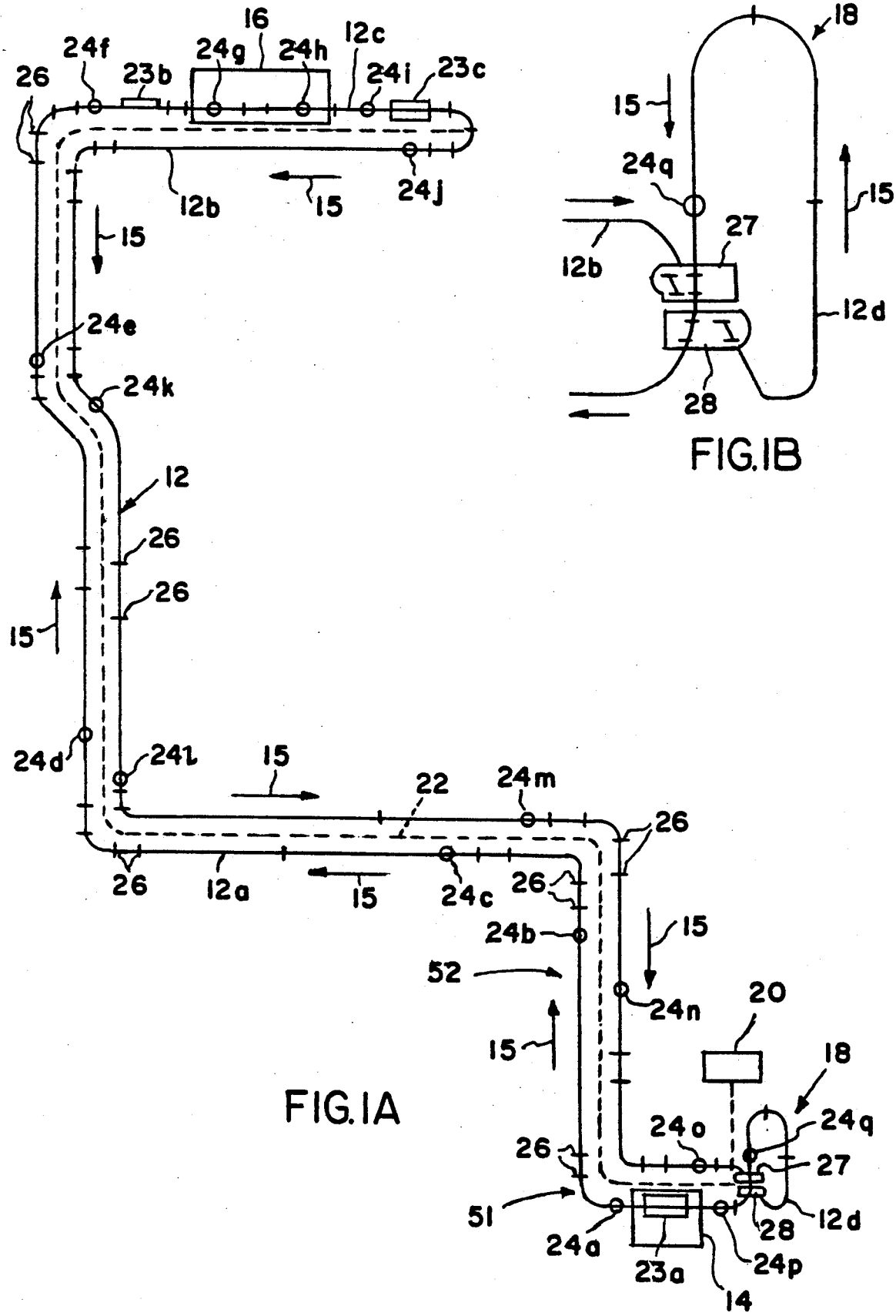
FIG. 1B is an enlarged view of the trolley repair/battery recharging area of the material handling system of FIG. 1A.

FIG. 1A schematically illustrates a material handling system according to a presently preferred embodiment of the invention. The system is generally designated by reference number 10 and includes one or more delivery devices 30 (FIG. 2) for carrying materials to be transported, at least one loading station 14 at which the delivery devices are loaded with the materials to be transported, at least one unloading station 16 at which the delivery devices are unloaded, and means 12 defining a pathway along which the delivery devices are adapted to travel from the loading station to the unloading station, and from the unloading station back to the loading station during operation of the system. In the preferred embodiment described herein, the pathway defining means 12 comprises an overhead monorail track system, and the delivery devices 30 comprise trolleys which are suspended from and travel along the monorail track system during operation of the material handling system.

The track system 12 is laid out in a generally closed loop and includes a supply side portion 12*a* for directing loaded trolleys from the loading station 14 to the unloading station 16, and a return side portion 12*b* for returning unloaded trolleys back to the loading station 14 to be reloaded. The arrows 15 in FIG. 1A illustrate the direction of travel of the trolleys through the system.

Track system 12 also includes a trolley repair/battery recharging area 18 which is illustrated more clearly in FIG. 1B and through which extends a track portion 12*d*. A pair of switches 27 and 28 controls travel of the trolleys between return track portion 12*b* and track portion 12*d*.

FIGS. 2 and 3 schematically illustrate a trolley 30 utilized in material handling system 10. Although in most large system several trolleys will be used, they are all substantially identical, and only one is described herein.

As shown in FIGS. 2 and 3, monorail track 12 comprises an I-shaped track of conventional construction. Trolley 30 includes front and rear generally C-shaped (in end elevation) trolley castings 31 and 32 which are adapted to extend above and below the track 12. A pair of wheels 33 and 34 is mounted to the castings and support the trolley 30 on track 12. Front wheel 33 is a driven wheel driven by a D.C. motor 35, whereas the rear wheel 34 is a non-driven wheel. A plurality of side guide rollers 36 are also mounted on the castings 31 and 32 and cooperate with the side surfaces of the track to maintain the trolley properly positioned on the track.

Trolley 30 also includes a control and battery enclosure 37 having a battery compartment for carrying one or more batteries and a control compartment for carrying trolley communication and control means as will be described hereinafter. A speed reducer gear box 38 is connected between the motor and the driven wheel 33 to transmit the motor rotation to the wheel.

Trolley 30 also includes appropriate load carrying means 40 which can comprise a container or other support means appropriate for the particular load that is to be handled by the system.

Trolley 30 preferably includes a photoelectric transmitter/receiver 43 on the front side thereof and a photoelectric reflector 44 on the back side thereof as a safety feature to prevent in known manner the trolley from colliding with another trolley or other obstacle in its path. In addition, the trolley preferably includes front and rear shock-absorbing bumpers 46 to protect the trolley when collisions do occur.

Referring again to FIG. 1A, system 10 also includes a central control console 20. As will be explained hereinafter, console 20 contains a central system electronic control means for controlling and monitoring the operation of system 10 and communication means for communicating with the trolley electronic control means as the trolleys travel through the system. As will also be explained in detail hereinafter, communication between the central system control means and the trolley control means is via an R.F. communication link such that direct electrical connection between the console and the trolleys is not required. Console 20 is, however, connected to a coaxial cable antenna system 22 which is installed parallel to the monorail track layout as illustrated in dashed line in FIG. 1A to allow communication between the central control console and each of the trolleys in the system at all times.

System 10 also includes a plurality of known vertical lifts 23*a*, 23*b* and 23*c* to raise and lower the trolleys in the system. Vertical lift 23*a* is located in the loading station 14 to bring empty trolleys down to ground level or other loading position to be loaded, and to return the loaded trolleys to the required height to meet the monorail track. Vertical lift 23*b* is located adjacent the entrance side of the unloading station 16 to lower loaded trolleys to a level to be unloaded, and vertical lift 23*c* is provided adjacent the exit side of the unloading station to return unloaded trolleys back to the level of the elevated monorail track for the return trip to the loading station. A lowered section 12*c* of the monorail track is positioned to carry trolleys from vertical lift 23*b* into the unloading station 16, and from the unloading station to vertical lift 23*c*.

A plurality of location points, designated by reference numbers 24*a*–24*q*, are positioned at predetermined locations along the track 12 to permit the position of the trolleys to be identified as they travel through the system. Each location point includes a bar code tag or other designator which is read or otherwise detected by each trolley as it passes the location point to generate a location message. Each location message is reported to the central control console via the R.F. communication link to permit the positions of the trolleys to be monitored thereat via a CRT screen on the console. In addition, certain location messages are used to initiate appropriate command signals from the trolley control means or the central system control means as will be explained hereinafter.

Finally, a plurality of mechanical fingers 26 are positioned at predetermined locations along the track 12 as shown in FIG. 1A (only a few of the fingers are numbered). Fingers 26 function as speed changing means and are adapted to be contacted by an electrical limit switch mounted on each trolley to change the speed of each trolley as it travels around the system. In this regard, each trolley drive motor 35 is operable at two-speeds and the fingers are generally positioned to cause each trolley to travel at a first, relatively fast speed on straight sections of the track, and at a second, relatively slow speed on curved sections of the track or when approaching track switches or vertical lifts.

In order to provide a clear understanding of the inventions, a detailed description of the operation of system 10 will now be given. In the following description, the path of one of the trolleys 30 will be followed through the entire system from the loading station 14 to the unloading station 16 and back to the loading station.

With reference to FIG. 1A, a trolley 30 initially is positioned at loading station 14 on vertical lift 23*a*. Lift 23*a* is in its lowered or loading position to permit the trolley to be loaded with material to be transported. After loading has been completed, vertical lift 23*a* is actuated to raise the trolley to the level of the monorail track. The trolley is then signalled to move forwardly along the track by command from the central control console 20 via the R.F. communication link.

The loaded trolley, initially travelling at slow speed, passes through location point 24*a* and reports its position to the central control console. After travelling through curved track portion 51, the limit switch on the trolley engages an appropriately positioned finger 26 on the track and switches the trolley to a fast speed for travel along straight track section 52.

The trolley continues through the system changing speeds as appropriate and reporting its location to the central control console as it passes through location points 24*b*–24*e* along the track. When the trolley reaches location point 24*f* adjacent the entrance to unloading station 16, it is commanded to stop and remains stationary until the following conditions are satisfied: (1) vertical lift 23*b* is in its raised position; and (2) no other trolley is present on vertical lift 23*b*. If these conditions are satisfied, the trolley is signalled to move forward at slow speed onto the lift 23*b*. Once on the lift, the trolley is again stopped, a known mechanical arresting device (not shown), locks the trolley in position on the lift, and the lift is signalled to descend to its lowered position so that the trolley can be directed, at slow speed, onto lowered track section 12*c* and into the unloading station 16. The unloading station includes location points 24*g* and 24*h* at which trolleys can be stopped for unloading. Once the trolley is clear of the vertical lift 23*b*, the lift is free to return to its raised position to receive the next loaded trolley.

When unloading of the trolley has been completed, a signal is sent from unloading station 16 to the central control console 20 which, in turn, signals the trolley to move forward at a slow speed until it reaches location point 24*i*. The trolley stops and remains at location point 24*i* until vertical lift 23*c* is empty and in its lowered position. When these conditions are satisfied, the trolley is allowed to travel onto lift 23*c*, is locked in position thereon, and lift 23*c* takes the trolley back up to the level of the elevated monorail for the return trip back to the loading station 14.

The normal starting position for vertical lift 23*b* is in the raised position ready to receive a loaded trolley from the elevated monorail track portion 12*a*, while the normal position of vertical lift 23*c* is in the lowered position ready to receive an empty trolley from lowered track portion 12*c*.

As the empty trolley returns to loading station 14, it passes a number of location points 24*j*–24*n* and stops at location point 24*o*. If no fault conditions have been reported during the trolley's trip through the system, it is routed via switches 27 and 28 (FIG. 1B) toward the loading station 14. If a fault condition is reported, however, the trolley is routed onto track portion 12*d* to be taken into trolley repair/battery recharging area 18.

Examples of trolley faults that might require the trolley to be routed into area 18 include motor overheating, low battery charge condition, and improper communication equipment operation. These faults are reported to the central control console by the onboard trolley control means and displayed to the sytem operator via the console CRT. Routing of the defective trolley into area 18 is accomplished automatically by the system, but the operator is required to check and repair, if necessary, any defects found in the trolley before it can be returned to the main track.

If a defect has been reported that requires the trolley to enter into trolley repair/battery recharging area 18, switches 27 and 28 are automatically shifted to cause the trolley to enter into area 18, and the trolley travels along track portion 12*d* to location point 24*q* where it is repaired. The size of the repair area is preferably such that several trolleys can be accommodated therein at the same time. Following the repair of a trolley, the operator manually operates switches 27 and 28 by electrical pushbuttons, and the trolley is commanded to move forward back onto the main track.

During the manual operation of returning a repaired trolley onto the main track, other trolleys in the system are prohibited from passing location point 24*o*. However, the trolley reinsertion process requires so little time that no significant backup will occur in the system. After the repaired trolley is returned to the main track, the switches are returned to their normal positions allowing subsequent trolleys to move freely from location point 24*o* to location point 24*p*.

When battery recharging is required, operator input is not necessary. The trolleys are routed into area 18, recharged automatically in known manner, and returned to the main track. Preferably, the batteries are recharged when the charge declines to about 80% of full charge capacity to ensure that they are adequately charged at all times. Locating the trolley repair/battery recharging area in the return side of the material handling system is preferred because it does not affect the overall operation of the material handling system since only empty trolleys are being serviced.

If there is no defect in the trolley operation, or after the trolley has been serviced and returned to the main track, the trolley travels to location point 24*p* where it is stopped to wait for the correct positioning of vertical lift 23*a* in its raised position. The trolley is then signalled to drive onto lift 23*a*, and is locked in position thereon. The lift is then lowered to permit the trolley to be reloaded to initiate the next cycle of operation of the system.

It should be understood that the particular configuration of system 10 a illustrated in FIG. 1A is meant to be exemplary only. For each application in which system 10 is used, it will be configured to satisfy the requirements of that particular application. For example, a typical system configuration may include one or more branching track portions with switches to control travel of the trolleys onto the branches. A configuration may also include several loading and unloading stations if required for a particular application. The location points 24 and speed control fingers 26 would also be positioned in various ways depending on the requirements of a particular system.

Reference is now made to FIGS. 4A and 4B which schematically illustrate the control compartment 60 of the battery and control enclosure 37 on each of the trolleys 30 in system 10. Compartment 60 contains the control and communication electronics for the trolleys. FIG. 4A schematically illustrates the interior of the control compartment, whereas FIG. 4B illustrates the front cover 61 of the compartment. As shown in FIG. 4A, the electronics include a two-way radio transceiver 62 for transmitting signals to and receiving signals from the central control console 20. A suitable radio is the Motorola Model HT-90 Handie-Talkie for 150–170 megahertz operation with R.F. transmitter output of 1–5 watts and modified to operate at 12 volts D.C. Radio 62 is connected to an externally-mounted flexible antenna 63 as also is shown in FIG. 2.

The electronics also includes a packet data controller 64 which includes a packet communications controller 64*a*, such as a Kantronics KPC-2, wired for 12 volt D.C. operation and connected to radio 62 via an RS-232 style computer grade cable or the like; an input/output device 64*b* such as a Kantronics TPC-1 reed relay input/output card wired for 12 volt D.C. operation and connected to the packet communications controller via computer grade cable; and a processor means such as a microprocessor integrated with the packet data controller and reed relay input/output card. The microprocessor preferably has 16 k of memory and includes a preprogrammed set of instructions suitable for the requirements of a particular system.

Also included in control compartment 60 are voltage regulators 65 and 66, a power relay 67, a motor control relay 68, a low battery voltage relay 69 and a motor speed change relay 71. In addition, a terminal strip 72 is mounted in the bottom of the control compartment for interconnecting wires from the various equipment in the compartment to external equipment; and several fuse holders are provided at 73.

The control compartment 60 also includes a plurality of plug-in connectors 74, 75, 76 and 77 for connecting the equipment therein to external components. Connector 74 provides connection to an excess temperature fault monitor 35*a* for detecting overheating of the trolley drive motor 35. Connector 75 provides connection to a manual control pendant 78 which is optionally included in the system to permit manual control over the trolley. Manual control pendant 78 includes an on-off button 78*a* for stopping the trolley in case of an emergency or other reason, and buttons 78*b* and 78*c* for causing the trolley to move in forward and reverse directions. Connector 76 provides connection to the battery compartment of enclosure 37 and connector 77 provides connection to the antenna 63.

The photoelectric transmitter/receiver 43 and the photoelectric reflector 44 are also preferably mounted on control compartment 60 as illustrated in FIG. 4A.

With reference to FIG. 4B, the control compartment cover 61 carries various components including an on-off switch 81, various LED indicators 82 for indicating when the power is on and the direction of drive motor operation (forward or reverse), fuse holders 83 and a battery voltage meter 84.

The central control console includes the same communication equipment as described above for each onboard trolley control, including a radio, packet communications controller and reed relay input/output card. Instead of a small flexible antenna, however, the central control console is connected to the coaxial cable antenna system 22 described previously. In addition, the processor means in console 20 will normally have a larger memory capacity than those in the trolleys. An IBM PC Jr., for example, will normally be suitable for use in the embodiment described herein. A 12 volt D.C. power supply is provided to power the operation of the equipment in the central console. Of course, the console will also include appropriate switches, indicators, terminals, fuses, and the like.

The R.F. communication link of the present invention preferably comprises a frequency modulated (F.M.) radio system to reduce interference from other electrical equipment that may be located within the environment of the material handling system. The communication system operates on an F.C.C. licensed frequency or channel in the simplex mode. A single channel is used for both transmitting and receiving commands to and from the central console.

A modem interfaces the computer in the central control console with the computers in the trolleys and performs the following functions:

1. Converts the basic computer program language into digitized audio-frequency tones compatible with the F.M. mode of radio operation;

2. Stores the basic commands in buffer memory and transmits in short bursts or "packets";

3. Generates and transmits a series of error checking and synchronization signals to ensure proper encoding and decoding of the basic message;

4. Controls the operation of each transceiver radio unit to prevent signal collisions; and 5. Encodes and decodes the digital addresses of each trolley radio in the system.

The operation of the trolley control means will now be described with reference to FIG. 5. Two batteries 91 and 92 are preferably provided in the battery compartment of the battery and control enclosure 37 of each trolley. Each battery is a 12 volt battery and is preferably of the sealed lead-acid type having 105 ampere hour ratings with leak-proof constructions and deep-cycling electrical capacity. A suitable battery is a Gould 12 volt gelcell battery. Batteries 91 and 92 are connected in series to produce 24 volts for high speed drive motor operation, and to power the 24 volt relays and the photoelectric transmitter/receiver in the circuit. Battery voltmeter 84 gives a continual readout of the batteries' voltage. It is connected across both batteries so that both can be checked with one meter. Fuse 93 is a 32 volt fuse used to protect the circuit in the event of a short circuit in the meter.

Recharging of the batteries 91 and 92 is through charging posts 94 and 95. Fuses 96 and 97 protect the charging circuit, and diode 98 prevents discharge of the batteries back through the battery charging system in case of a malfunction. Circuit breaker 99 functions as the main power on/off switch and as short circuit protection of the remaining components in the control compartment. All three lines of the battery supply are open when circuit breaker 99 is in the off positiion.

Low battery voltage relay 69 is a voltage sensitive device to initiate an alarm if the battery voltage falls below 80% of full charge level, and fuses 101 and 102 protect the 24 volt and 12 volt lines, respectively. Voltage regulators 65 and 66 provide constant voltage for the 24 volt and the 12 volt circuits under varying load conditions. The photoelectric transmitter/receiver 43 operates from the 24 volt power supply as indicated.

The contacts of the speed control relay 71, one set in the 24 volt supply, and one set in the 12 volt supply allow for the two trolley drive motor speeds; and the contacts are arranged to preclude both fast and slow speeds at the same time. Also, the fast travel speed is permitted only in the forward mode by means of interlocking contacts in the control output command ladder diagram shown in FIG. 5. Forward or reverse travel of the trolley is provided by the contacts of the motor control relay 68. By selecting the polarity of the direct current applied to the drive motor, clockwise or counterclockwise rotation will result.

The motor is connected to the input shaft of a right-angled gear box 38 (FIGS. 2 and 3) having an output shaft connected to the trolley's driven wheel 33, and will result in the trolley's movement, either forward or backward, depending on the rotation of the drive motor. Diode 103 is a transient voltage protection device to reduce arcing of the contacts in the motor control relay. The trolley drive motor 35 is a direct current, low voltage, fractional horsepower, permanent magnet-type motor as is well known in the industry. A suitable motor is a Leeson permanent magnet 0.25 horsepower D.C. motor.

The electronics, the radio 62 and the packet data controller 64 are all powered from the 12 volt positive supply line located at point 106, the junction of the batteries 91 and 92; with the common or return line to the negative post of battery 92 being via point 107.

FIG. 6 illustrates the output commands from the packet data controller 64 to the electro-mechanical relays which switch the direct current for operation of the trolley drive motor and other components. Outputs 1–3 are shunted by the pushbuttons **78*a*–78*c* of the manual pendant 78, thus allowing movement of the trolley without the use of the computer in the central control console. Pendant 78 is for maintenance use only, as an electrical connection inside the pendant appears as input signal 6 causing the packet data controller to disregard signals from the computer and accept only commands from the pendant. Removal of the pendant from connector 75** returns control to the packet data controller for automatic operation.

The first ouput command is to turn on the D.C. power to the trolley. The power relay 67 is energized, as indicated by the appropriate L.E.D. on the front panel 61 of the control compartment. If output 2 is energized, and the photoelectric transmitter/receiver does not detect another trolley in the path, motor control relay 68 is turned on causing the trolley to move forward at slow speed because only 12 volts D.C. is being applied to the 24 volt motor. The motor will operate at one-half its rated speed, that is, if the motor is rated at 3600 R.P.M. at 24 volts D.C., at 12 volts D.C. it will operate at 1800 R.P.M., thus moving the trolley at one-half its normal speed. If the trolley is to travel in reverse, output 2 will be shut off and output 3 will be energized operating the reverse motor relay, again indicated by the appropriate L.E.D. on the front panel 61. For the trolley to move forward at fast speed (24 volts applied to the motor), the speed control relay 71 must be energized. Electrical interlocking permits the use of this command only in the forward travel mode. A loss of the power relay 67 at any time will stop the motion of the trolley and cause an alarm to be sent to the central console computer.

The motor temperature signal (input 4) is normally on at all times providing a fail-safe monitoring of the motor electrical windings. If an abnormally high temperature is reached, the contact will open resulting in a loss of the input. The packet data controller will shut off the motor drive relay and transmit an alarm to the central console computer for action by maintenance personnel.

Input 5 is the low battery voltage signal, which is transmitted to the central console computer to schedule the trolley for recharging in a conventional manner.

All of the input signals are transmitted to the central console computer, giving the computer a continual update as to the trolley's direction of travel, speed and any faults that might occur.

The R.F. communication means can also be used to actuate switches which may be in the track system to move a trolley to a branch portion of the system, or for other purposes. For example, a trolley, knowing it is approaching a switch to be actuated (as a result of having passed an appropriately positioned location point), transmits a command coded only for that switch. The command is received and decoded by a packet modem on the switch and the switch is activated. This action causes an acknowledgment signal to be sent to the trolley to continue its forward travel. If this acknowledgment is not received by the trolley, it may be instructed not to continue until the pathway is proper.

The disclosed embodiment is representative of the preferred form of the invention, but is intended to be illustrative rather than definitive thereof. The invention is defined in the claims.

I claim:

1. A material handling system comprising:

at least one delivery device;

means for defining a pathway along which said delivery device is adapted to travel; and central electronic control means for controlling the operation of said system;

each of said delivery devices including drive means for driving the delivery device along said pathway; an onboard power supply for providing power to said drive means; and an onboard electronic control means for controlling operation of said delivery device;

said onboard electronic control means including an onboard transceiver and said central electronic control means including a central transceiver for providing a radio frequency communication link between said central electronic control means and said onboard electronic control means;

said onboard transceiver being capable of transmitting plural information signals to said central transceiver, said central transceiver being capable of receiving said information signals and for transmitting control signals to said onboard transceiver for control of said delivery device;

said drive means comprising a DC motor and said onboard power supply comprising a rechargeable battery;

means for monitoring the charge of said rechargeable battery and for generating a low battery signal when said charge drops below a predetermined level, said means for defining a pathway comprising track means which includes a supply track portion along which the delivery device is adapted to travel with a load from a loading station to an unloading station, a return track portion along which said delivery device is adapted to travel from said unloading station to said loading station, and a repair/battery recharging track portion with a track switching means for guiding the delivery device from said return track portion to said repair/battery recharging track portion for recharging said battery when said onboard electronic control means generates said low battery signal.

2. The material handling system of claim 1 wherein said onboard electronic control means includes means for monitoring said D.C. motor means and for generating a signal when an overheating condition occurs in said D.C. motor means.

3. The material handling system of claim 1 wherein said onboard electronic control means includes speed controlling means for said DC motor for changing the speed at which said delivery device is driven along said pathway;

said pathway including a plurality of speed changing signal means positioned at predetermined locations therealong, said speed controlling means including means responsive to said speed changing signal means for changing the speed of said DC motor between a relatively fast speed and a relatively slow speed.

4. The material handling system of claim 1 wherein said pathway includes a plurality of location points positioned at predetermined locations therealong, and wherein said onboard electronic control means includes means responsive to said location points and for generating a signal indicative of the position of said delivery device on said pathway.

5. The material handling system of claim 1 and further including a coaxial antenna system connected to said central electronic control means and extending substantially the length of said pathway.

6. The material handling system of claim 1 wherein each of said delivery devices includes photoelectric means for detecting an obstacle in its path, and wherein said onboard electronic control means includes means responsive to said photoelectric means for generating a signal to stop said delivery device when an obstacle is detected.

7. The material handling system of claim 1 wherein said system comprises a monorail material handling system.

* * * * *